US005361692A

United States Patent [19]

Zimmer

[11] Patent Number: 5,361,692

[45] Date of Patent: Nov. 8, 1994

[54] COMPACTION SYSTEM FOR METAL DRUMS

[76] Inventor: John Zimmer, 2419 Bayou Bend, New Iberia, La. 70119

[21] Appl. No.: 228,921

[22] Filed: Apr. 18, 1994

Related U.S. Application Data

[63] Continuation of Ser. No. 959,750, Oct. 13, 1992, abandoned.

[51] Int. Cl.[5] ..... B30B 15/04

[52] U.S. Cl. ..... 100/229 A; 53/527; 100/240; 100/255; 141/80; 141/390

[58] Field of Search ..... 100/229 R, 229 A, 240, 100/245, 246, 255, 54–64, 252; 53/527; 141/73, 80, 390; 252/626, 633

[56] References Cited

U.S. PATENT DOCUMENTS

| | | | |
|---|---|---|---|
| 69,721 | 10/1867 | Stover | 100/56 |
| 884,450 | 4/1908 | Wright | 220/654 |
| 1,063,152 | 5/1913 | Bauroth | 220/654 |
| 1,313,387 | 8/1919 | Kaarbo | 220/654 X |
| 1,483,293 | 2/1924 | Foster et al. | 220/654 X |
| 2,164,660 | 7/1939 | Miller | 220/654 |
| 2,181,945 | 12/1939 | Komarik | 141/80 |
| 2,224,908 | 12/1940 | Griffith | 100/58 X |
| 2,269,617 | 1/1942 | Borstel | 220/654 |
| 2,445,730 | 7/1948 | Kuhn | 220/654 X |
| 2,711,264 | 6/1955 | Benson | 220/651 X |
| 2,922,360 | 1/1960 | Monk, Jr. | 100/915 X |
| 3,734,006 | 5/1973 | Hennells | 100/229 A X |
| 3,853,052 | 12/1974 | Engebretsen | 100/229 A |
| 3,937,354 | 2/1976 | Clar | 100/229 A X |
| 4,008,658 | 2/1977 | Stock et al. | 100/229 R X |
| 4,554,868 | 11/1985 | Zimmer | 100/229 R |
| 4,559,870 | 12/1985 | Krummacher et al. | 100/215 |
| 4,564,469 | 1/1986 | Cochet et al. | 53/527 X |
| 4,656,937 | 4/1987 | Turner, Jr. | 100/229 A X |
| 4,719,852 | 1/1988 | Durbin et al. | 100/229 A |
| 4,876,955 | 10/1989 | Jackson | 100/229 A X |

*Primary Examiner*—Stephen F. Gerrity
*Attorney, Agent, or Firm*—Pravel, Hewitt, Kimball & Krieger

[57] ABSTRACT

A system for compacting material within a drum which includes a substantially tubular chamber, for placing a standard 55-gallon drum within, of the type having roll rings spaced along its annular wall; the chamber including a pair of swing away doors, for allowing access for the drum, and for closing around the wall of the drum, defining a portion of the inner wall of the chamber; a ram, configured in a dimension to fit within the drum opening for compacting material contained within the drum, and a series of thick, metal bands along the interior wall of the chamber, spaced apart so that one of the metal bands fills each space between the wall of the drum between the roll ring and the chamber wall.

10 Claims, 5 Drawing Sheets

COMPACTION SYSTEM FOR METAL DRUMS

This is a continuation of co-pending application Ser. No. 07/959,750 filed on Oct. 13, 1992 now abandoned.

BACKGROUND OF THE INVENTION:

1. Field Of The Invention

The apparatus of the present invention relates to drums. More particularly, the present invention relates to a system for compacting material in a standard drum, with the system providing a means to prevent the walls of the drum, between the roll rings, from expanding and rupturing during the compaction process.

2. General Background

In the art of compaction, oftentimes, 55-gallon drums are used as the vessel into which material is compacted because of the features which allow a strong container that can be easily stored. However, one of the shortcomings which has plagued the art in compacting material in such a drum, is the rupturing of the side wall due to the fact that only the roll rings are supported by the wall of the container. The roll rings are a series of raised rings formed in the drum wall, spaced along the length of the side wall, so that when the drum is placed on its side, the drum can be easily rolled since only the rings make contact with the surface it is being rolled along.

During the compaction process, a drum is placed within a chamber and the chamber wall fits snugly around substantially the entire drum wall, to support it under the compaction force, so that if the drum ruptures, workers around the compaction side are not injured, or contamination of hazardous waste contained within the drum is avoided. However, because of the raised roll rings, the wall of the chamber makes contact with the rings, and there remains a void space of around 1 inch between that portion of the drum wall between the roll rings, and the chamber wall. This void space probably comprises some 95% of the drum wall surface. Therefore, often during compaction, the drum wall, under the great forces of the ram, will bulge into the void space, and a rupture will result. Therefore, a drum is ruined, and the compaction process must be undertaken once again, with perhaps the same results, such as dangerous radioactive or flammable or caustic or corrosive material being discharged through the ruptured wall. It should be noticed also that most compactors in the art have in position an "anvil" on the floor of the compactor to compensate for the raised floor of the drum from rupturing when material is forced downward into the drum. However, this failed to solve the problem of the greater majority of the drum wall not being in contact with the wall of the compaction.

Patents have been found which attempt to address the problem confronted and solved by this invention.

Other objects of the invention will be obvious to those skilled in the art from the following description of the invention.

SUMMARY OF THE PRESENT INVENTION

The system of the present invention solves the problems in the art in a simple and straightforward manner. What is provided is a substantially cylindrical chamber, for placing a standard 55-gallon drum, or slightly larger sizes, within, of the type having roll rings spaced along its side wall. The chamber includes a pair of swing away doors, for allowing access for the drum, and for closing and locking around the wall of the drum, to define a portion of the inner wall of the chamber. There is further provided a ram, configured in a dimension to fit within the drum opening for compacting material contained within the drum. There is further included a series of thick, metal bands along the interior wall and doors of the chamber, spaced apart so that one of the metal bands fills each void space between the wall of the drum between the roll ring and the chamber wall.

Therefore, it is a principal object of the present invention to provide a compaction system of materials within metal drums, more particularly, 55-gallon drums, so that when the compaction process is undertaken, there is very little void space between the drum wall and the chamber wall, and the wall of the drum is unable to expand and rupture within the space;

It is a further object of the present invention to provide a chamber for placing a 55-gallon drum, of the type having roll rings, within, so that upon closing of the chamber around the drum, the space between the drum wall and the chamber wall is occupied by a layer of material;

It is still a further object of the present invention to allow the compaction of material within drums having a series of roll rings along its side wall without causing rupture to the wall of the drum between the roll rings during compaction;

It is still a further object of the present invention to provide a compaction system which can accommodate various OD size drums utilizing heavy duty clamps along the double hinge doors of the system, for allowing the drums to be supported around their entire wall when the clamps are adjusted to accommodate the different size drums.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
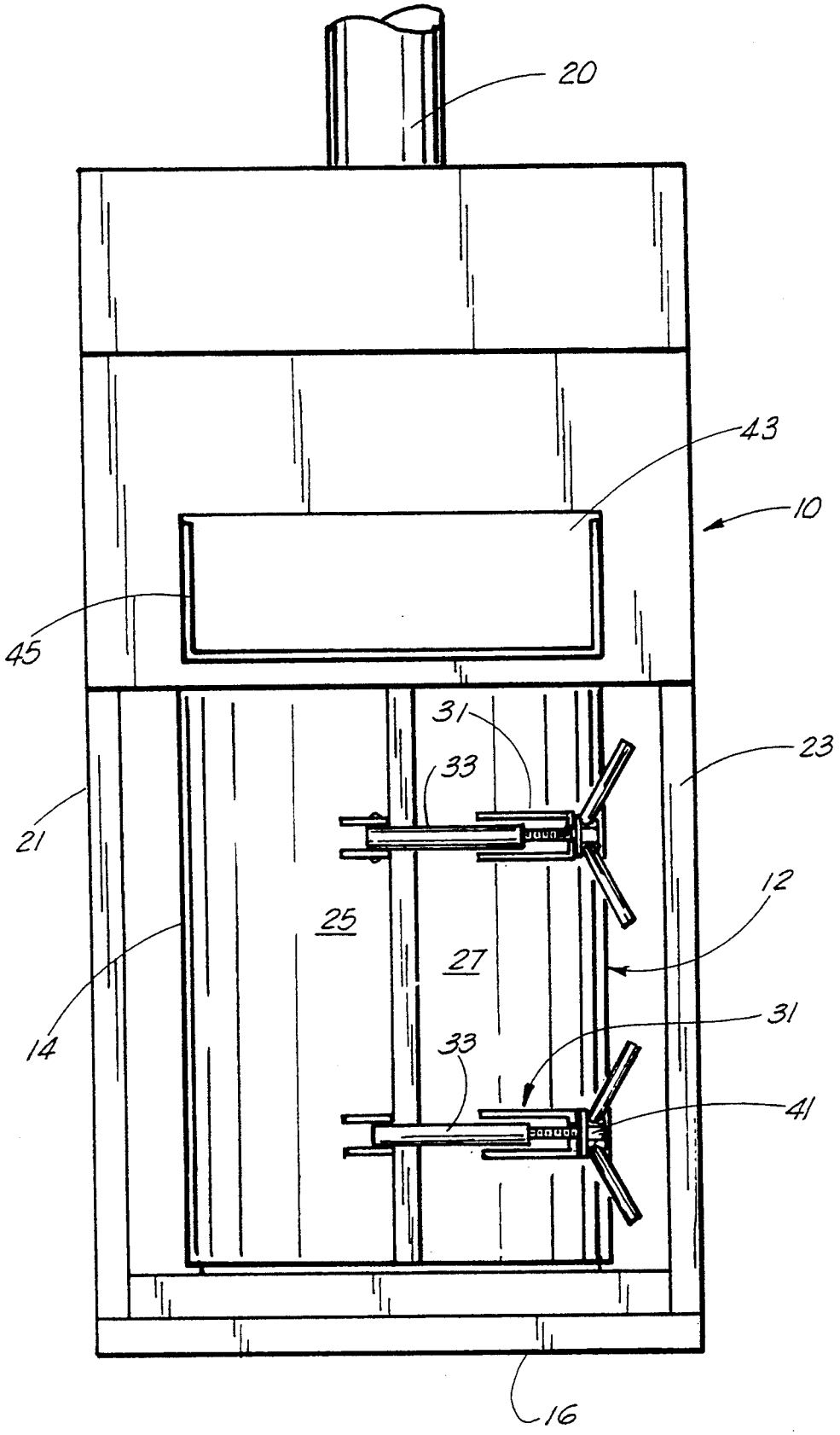
FIG. 1 illustrates an overall front view of the compaction system of the present invention.
Figure 2:
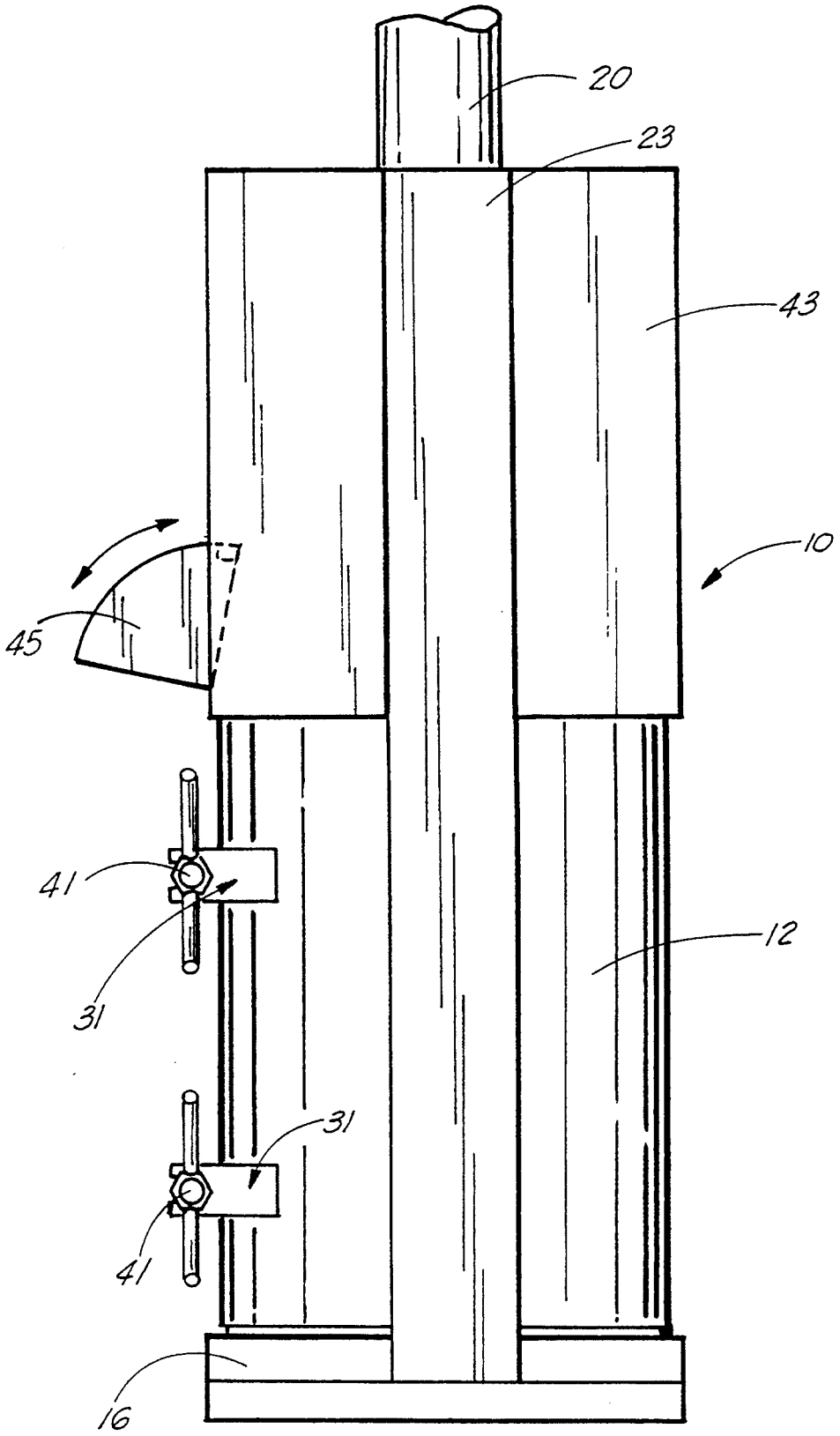
FIG. 2 illustrates an overall side view of the compaction system of the present invention.
Figure 7:
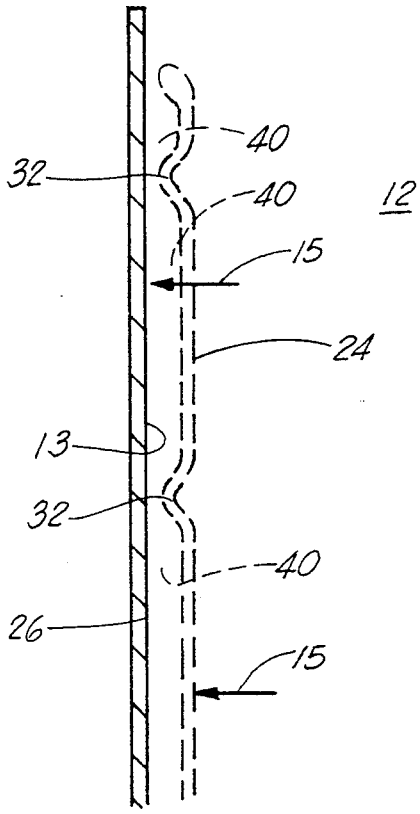
FIG. 7 illustrates a partial cross-section view of a drum positioned within a prior art-type compaction chamber.
Figure 3:
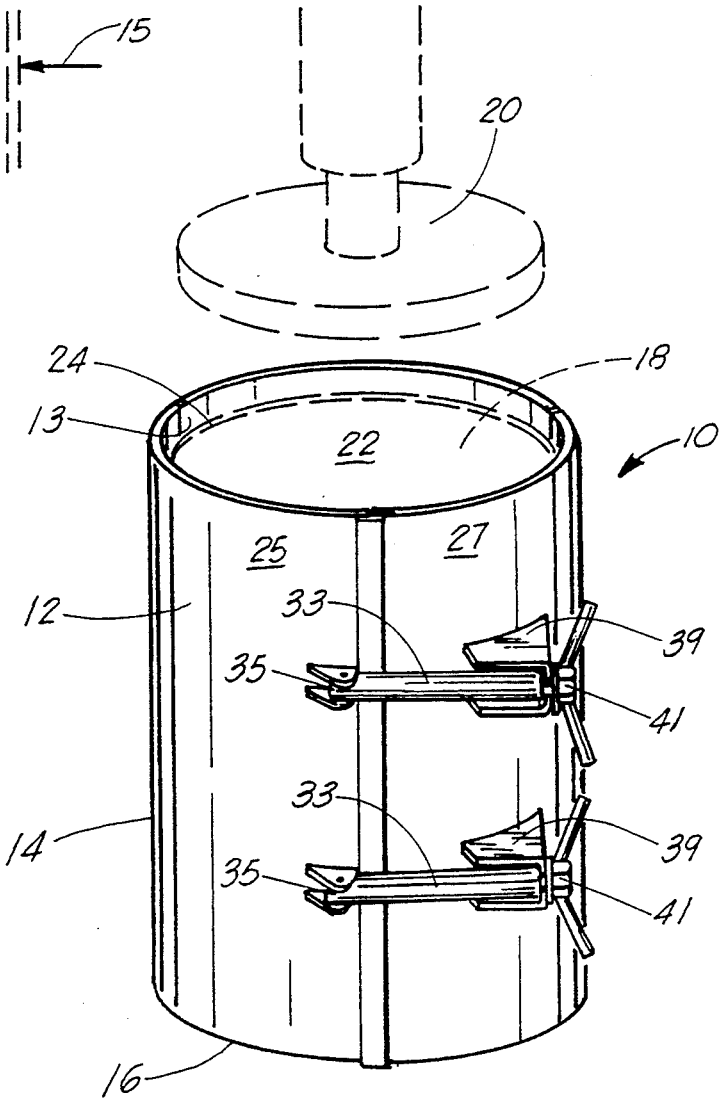
FIG. 3 illustrates a partial view of the compaction chamber with the ram in phantom view.

The system of the present invention is illustrated in FIGS. 1 through 6 by the numeral 10, with FIG. 7 illustrating a prior art compaction container. As illustrated, system 10 includes a compaction chamber 12, of the type having an annular wall 14, a floor portion 16, and an open top 18, so that a compaction ram 20, (as seen in phantom view in FIG. 3), driven by hydraulic fluid of the like, can compact material within the space 22 within chamber 12 defined by wall 14. As seen in FIGS. 1 and 2, the system would also include an outer support structure 19, having a pair of support legs 21, 23 to support the compaction chamber and ram.

Figure 6:
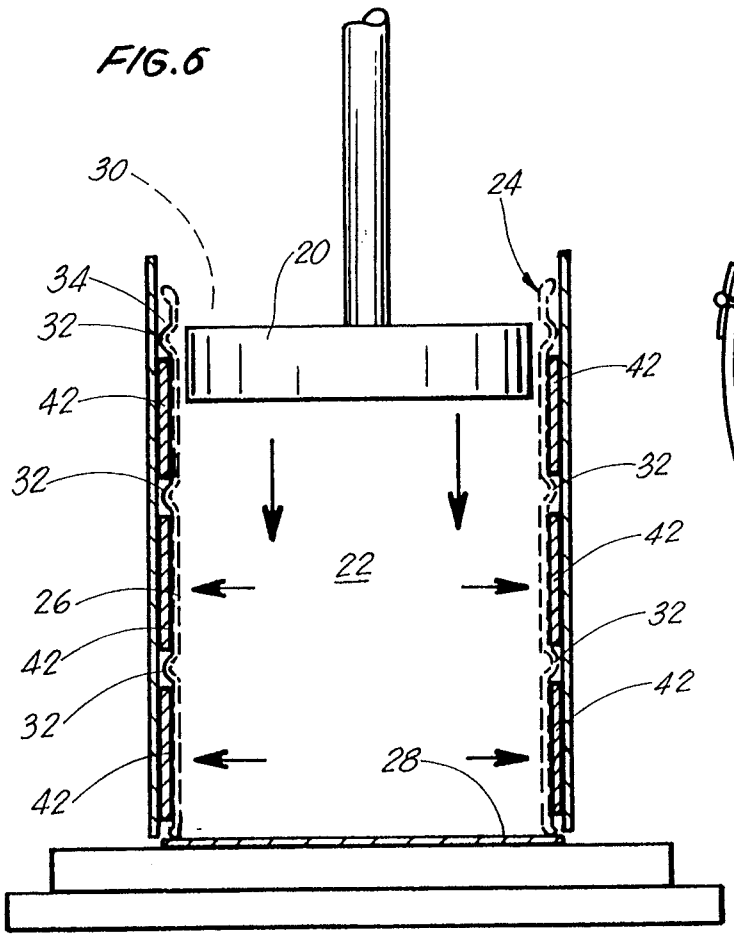
FIG. 6 illustrates a cross-section view of the compaction chamber with the ram contained therein.

As illustrated, chamber 12 would be configured with a sufficient diameter to accommodate a standard 55-gallon drum 24, of the type, as seen in cross-section in FIG. 6, having an annular wall 26, a bottom 28, an open top 30, and a plurality of raised rings 32, spaced along its wall 26, known in the art as roll rings 32. As is illustrated, the roll rings 32 extend a distance 34 out from the wall 26 of drum 24, so that when the standard drum is rolled along a surface, the entire wall 26 does not make contact, but the drum 24 rolls along the roll rings 32.

Figure 4:
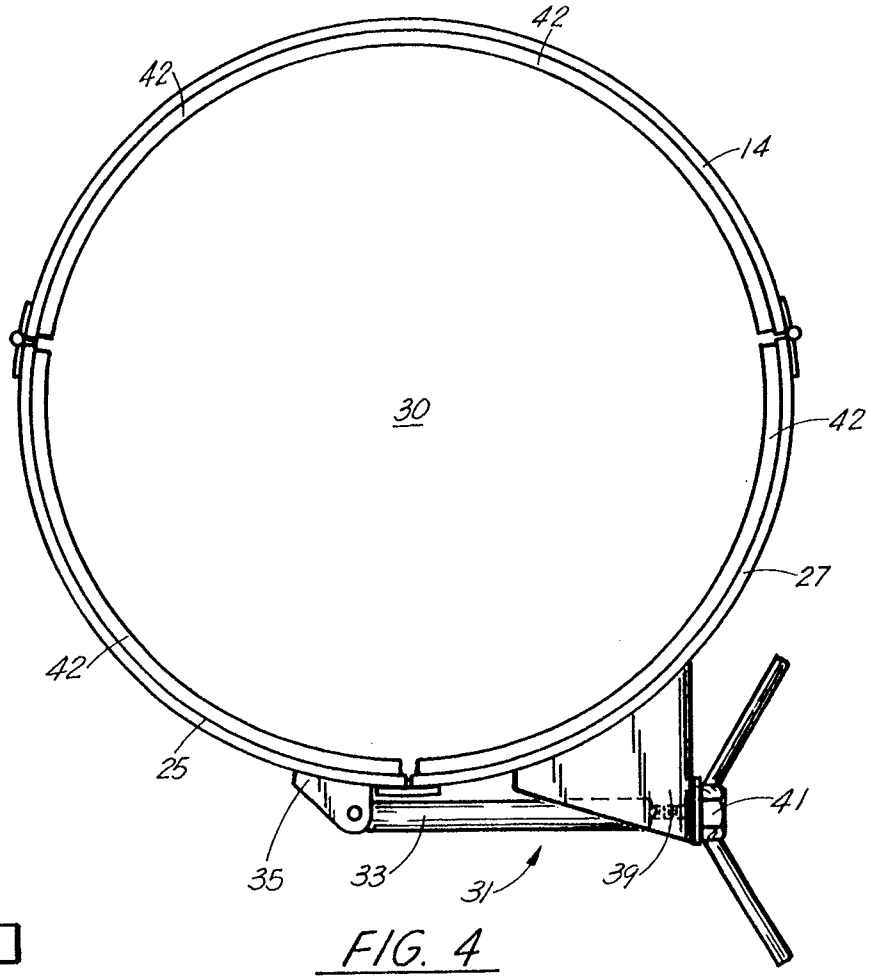
FIG. 4 illustrates a top view of the compaction chamber of the present invention in the closed position.
Figure 5:
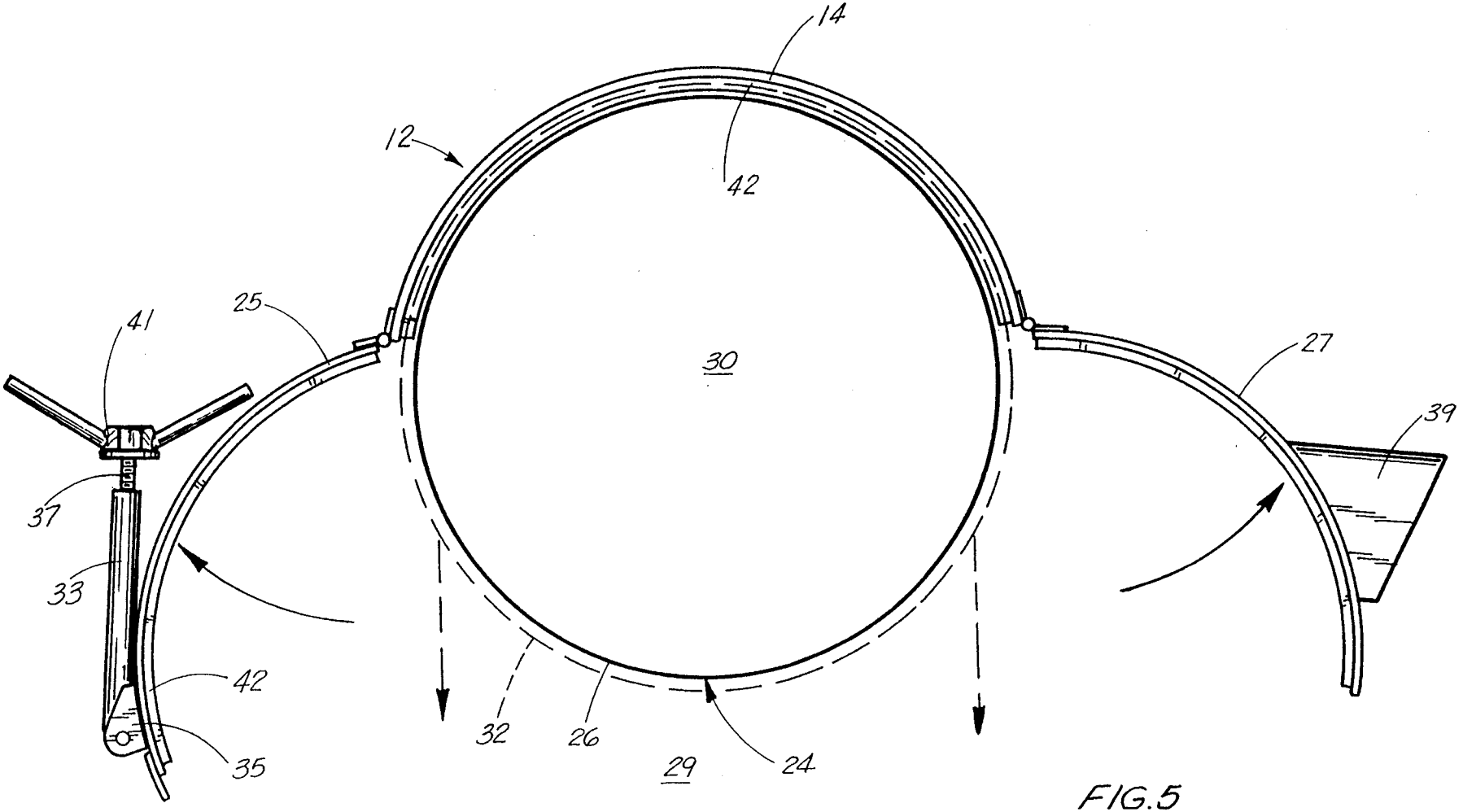
FIG. 5 illustrates a top view of the compaction chamber of the present invention in the open position.

As further seen in the Figures, in order to easily position and retrieve drum 24 from the compaction chamber 12, there would be provided a pair of doors, 25, 27, together, as seen in FIGS. 4 and 5, forming a semicircular opening 29 to chamber 12, for placing a drum 24 therein. As illustrated further, the chamber doors 25, 27 are maintained secured around a drum 24, via an upper and lower locking means 31. Each of these locking means 31 comprises a locking pin 33, swivelly connected on a first end 35 to door 25, and having a threadable bolt 37 threaded into its second end. The pin 33, would engage a locking member 39 on door 27, when the doors are closed, so that upon threading of bolt 37 via a handle 41, a secure closure would be formed around drum 24 so that compaction could take place.

Further, FIGS. 1 and 2 illustrate a hopper 43 positioned over the chamber 12, having a drop door 45 for allowing material to be placed within hopper 41 via door 45, to be deposited in drum 24 for compaction. Of course when compaction is undertaken, the door 45 of hopper 43 would be maintained closed.

FIG. 7 illustrates a partial view of a compaction chamber wall of the type presently in the art with a drum 24 therein. As is illustrated, the roll rings 32 do extend outward from wall 26, when a drum is placed within a chamber, of the basic type as chamber 12, theoretically, the inner wall 13 of chamber 12 could make contact only with the raised rings 32. That being the case, as seen, there would be created a series of void spaces 40 between the wall 14 of the drum 12 and the wall 13 of the chamber 12. Therefore, when material is compacted within drum 24, as seen in FIG. 7, the wall 14 of the drum 24 would tend to expand outward in the direction of arrow 15, into the void 40, and in doing so, often times would rupture.

Therefore, as illustrated in side view in FIG. 6, and in top view in FIG. 4, the present invention would provide a series of raised metal rings 42 positioned around the annular wall 13 of chamber 12, including the doors 25, 27 through welding or the like, of the width and thickness sufficient to fill the void 40 as previously described in FIG. 7. Each ring 42 would be the thickness of the depth of void space 42 and would be present to fill each void space created between the roll rings 32. Therefore, when doors 25 and 27 are closed around drum 24, the raised rings 42 would form a set of continuous rings 42 surrounding drum 24, which would eliminate all void spaces 40 as illustrated in FIG. 6. That being the case, when the compaction process is undertaken, the wall 14 of drum 24 would, upon expansion, immediately contact the raised rings 42, and therefore, no further expansion would take place, and rupturing of the wall 14 would be avoided, as is common in the prior art illustrated in FIG. 7.

Following the compaction process, the doors 25, 27 of chamber 12 would be opened, and the compacted material in drum 24 would be removed for disposal. This unique system could be constructed as a new and improved system, or the raised rings 42 could be adapted to a standard compaction chamber to eliminate the constant problem of ruptured drum walls 14 caused by void space 40.

Glossary of Terms system 10
compaction chamber 12
inner wall 13
annular wall 14
arrow 15
floor portion 16
open top 18
support structure 19
compaction ram 20
support legs 21, 23
space 22
drum 24
annular wall 26
bottom 28
open top 30
roll rings 32
distance 34
doors 25, 27
semi-circular opening 29
locking means 31
locking pin 33
first end 35
threaded bolt 37
locking member 39
handle 41
void spaces 40
raised metal bands 42
hopper 43
door 45

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A system for compacting materials within a metal drum of the type having a series of roll rings along the outer wall of the drum, the system comprising:

a) a cylindrical chamber, having an inner wall, of the dimension to accommodate the metal drum therewithin;

b) a ram member, positioned above the chamber, and moveable to a down position during compaction of the material in the drum;

c) door portions forming a portion of the chamber and each having an inner wall for allowing placement into and removal of the drum from the chamber; and d) raised means along substantially the entire inner wall of each of the chamber and the door portions for filing all void space otherwise created by the roll rings between the outer wall of the drum and the inner walls of the chamber and the door portions, so that upon being subjected to compaction force, substantially the entire wall of the drum is prevented from expanding into the void space to avoid rupturing any portion of the drum wall.

2. The system in claim 1, wherein the means for filling the void between the outer wall of the drum and the inner walls of the chamber and the door portions further comprise a raised band of metal positioned along the inner walls of each of the chamber and the door portions of the thickness and width to fill the void space.

3. The system in claim 1, wherein the door portions further comprise a pair of chamber doors which when open are able to accommodate the passage of a metal drum therethrough.

4. The system in claim 1, further comprising locking means on the door portions of the chamber for maintaining the drum securely within the chamber during compaction.

5. The system in claim 1, wherein the drum would further comprise an open-ended 55-gallon drum.

6. A system for compacting materials within a 55-gallon drum of the type having a series of roll rings along its outer wall, the system comprising:

a) a chamber having an inner wall, of the dimensions to accommodate a 55-gallon drum therewithin;

b) a hydraulic-powered ram member, positioned above the chamber, and moveable to a down position into the drum for compaction of material in the drum;

c) door means forming a portion of the chamber and having an inner wall for allowing placement into and removal of the drum from the chamber; and d) a series of raised metal bands positioned along substantially the entire inner walls of the chamber and the door means to occupy a void space created by the raised roll rings, so that during compaction of material in the drum, substantially the entire wall of the drum is prevented from expanding into the void space to avoid rupturing any portion of the drum wall.

7. The system in claim 6, wherein the raised metal bands along the inner wall of the chamber comprise metal bands welded to the inner wall of the chamber.

8. A system for compacting materials within a metal drum of the type having a series of roll rings along its outer wall, to eliminate rupturing of the drum wall in that area of the wall between the roll rings during compaction, the system including a chamber of a dimension to accommodate a metal drum therewith; a ram member, positioned above the chamber, and moveable to a down position during compaction of the material in the drum; doors on the chamber for allowing placement into and removal of the drum from the chamber;

the improvement comprising a raised metal band positioned along the wall of the chamber and the doors for defining a means to fill the void between the wall of the drum between the roll rings and the wall of the chamber and the doors of the chamber, so that during compaction of material in the drum, the wall of the drum is prevented from expanding into the void space to avoid rupturing of the drum wall.

9. The system in claim 8, wherein the drum would further comprise a 55-gallon drum.

10. The system in claim 8, further comprising locking means on the doors to secure the drum within the chamber during compaction.

* * * * *